US009895895B2

(12) United States Patent
Ohnishi

(10) Patent No.: US 9,895,895 B2
(45) Date of Patent: Feb. 20, 2018

(54) HEAD WASHING DEVICE AND INKJET PRINTER

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/323,103

(22) PCT Filed: Jul. 2, 2015

(86) PCT No.: PCT/JP2015/069173
§ 371 (c)(1),
(2) Date: Dec. 30, 2016

(87) PCT Pub. No.: WO2016/002896
PCT Pub. Date: Jan. 7, 2016

(65) Prior Publication Data

US 2017/0157935 A1 Jun. 8, 2017

(30) Foreign Application Priority Data

Jul. 3, 2014 (JP) ..... 2014-138137

(51) Int. Cl.
*B41J 2/165* (2006.01)

(52) U.S. Cl.
CPC ..... *B41J 2/16535* (2013.01)

(58) Field of Classification Search
CPC ..... B41J 2/16552; B41J 2/16535; B41J 2/16538; B41J 2/16541; B41J 2/16544; B41J 2002/1655; B41J 2/16588; B41J 2/165; B41J 2/16517
USPC ..... 347/22, 28, 33
See application file for complete search history.

(56) References Cited

U.S. PATENT DOCUMENTS 7,824,004 B2 * 11/2010 Tokuno ..... B41J 2/16538 347/22
2016/0031221 A1 * 2/2016 Fernando ..... B41J 2/16547 347/33

FOREIGN PATENT DOCUMENTS

| | | |
|---|---|---|
| JP | 2007-163751 | 6/2007 |
| JP | 2009-132007 | 6/2009 |
| JP | 2010-260211 | 11/2010 |
| JP | 2012-206366 | 10/2012 |

OTHER PUBLICATIONS

"International Search Report (Form PCT/ISA/210)", dated Aug. 11, 2015, with English translation thereof, pp. 1-4.

* cited by examiner

*Primary Examiner* — Jannelle M Lebron
(74) *Attorney, Agent, or Firm* — JCIPRNET

(57) ABSTRACT

In order to effectively wash wiping members, a washing station which is a head washing device according to one embodiment of the present invention is characterized by including a wiping unit, a storage tank, and a washing unit. The wiping unit includes wipers which are wiping members for wiping an ejection surface of an inkjet head. In the storage tank, washing solution for washing the wiping unit is stored. The washing unit washes the wipers in the washing solution of the storage tank.

10 Claims, 7 Drawing Sheets

HEAD WASHING DEVICE AND INKJET PRINTER

CROSS-REFERENCE TO RELATED APPLICATION

This application is a 371 of international application of PCT application serial no. PCT/JP2015/069173, filed on Jul. 2, 2015, which claims the priority benefit of Japan application no. JP 2014-138137, filed on Jul. 3, 2014. The entirety of the above-mentioned patent applications is hereby incorporated by reference herein and made a part of this specification.

TECHNICAL FIELD

The present invention relates to a head washing device and an inkjet printer.

BACKGROUND ART

An inkjet printer has a plurality of nozzles for ejecting ink. To an ejection surface having those nozzles, contaminations such as ink may attach. It is known an inkjet printer configured to remove contaminations of such an ejection surface by a wiping member such as a wiper.

CITATION LIST

Patent Literature

Patent Literature 1: JP-A-2009-132007

SUMMARY

Technical Problem

Contaminations of the wiper can be removed, for example, by another member. However, it is feared that contaminations such as ink with increased viscosity may remain on the wiper.

An example of tasks to be achieved by the present invention is to provide a head washing device and an inkjet printer capable of effectively washing a wiping member.

Solution to Problem

A head washing device according to one embodiment of the present invention is characterized by including a storage tank, a wiping unit, and a washing unit. In the storage tank, washing solution for washing the wiping unit is stored. The wiping unit has a wiping member for wiping an ejection surface. The washing unit washes the wiping member in the washing solution of the storage tank.

The washing unit washes the wiping member for wiping the ejection surface of an inkjet head, using the washing solution of the storage tank. Contaminations attached to the wiping member are mixed in a large amount of washing solution contained in the storage tank. In this way, the wiping member is effectively washed, whereby it is possible to suppress contaminations remaining on the wiping member from adhering to the ejection surface of the inkjet head.

In the above-described head washing device, it is preferable that the washing unit include a washing member whose at least a portion is immersed in the washing solution of the storage tank and which comes into contact with the ejection surface of the inkjet head and the wiping member and washes the ejection surface and the wiping member.

The washing member washes the ejection surface of the inkjet head and the wiping member. In this way, the ejection surface and the wiping member are washed more effectively. If the ejection surface is wiped by the wiping member (for example, a wiper) in a state where contaminations such as ink have attached to the ejection surface, the contaminations may be jammed into some nozzles existing in the ejection surface, thereby causing nozzle clogging. For this reason, if the ejection surface of the inkjet head is washed by the washing member, it is possible to suppress contaminations such as ink from entering nozzles, thereby suppressing nozzle clogging from occurring. Further, since one washing member washes the ejection surface and the wiping member, the number of components of the head washing device is reduced, and the space of the head washing device is saved.

In the above-described head washing device, it is preferable that the wiping member have a contact portion which is in contact with the ejection surface of the inkjet head, and the contact portion be exposed from the washing solution of the storage tank when the wiping member wipes the ejection surface, and be immersed in the washing solution of the storage tank when the washing unit washes the wiping member.

When the wiping unit washes the wiping member, the contact portion of the wiping member is immersed in the washing solution of the storage tank. Therefore, contaminations attached to the wiping member are mixed in the large amount of washing solution contained in the storage tank, whereby the wiping member is more effectively washed. Further, when the wiping member wipes the ejection surface of the inkjet head, the contact portion of the wiping member is exposed from the washing solution. If the wiping member from which these contaminations have been washed away wipes the ejection surface, the washing solution remaining on the ejection surface washed by the washing unit is wiped off, and the corresponding ejection surface becomes likely to dry. As a result, workability of washing of the ejection surface improves.

In the above-described head washing device, it is preferable that the head washing device further include an automatic level adjustment mechanism capable of changing the position of the solution level of the washing solution of the storage tank.

By changing the position of the solution level of the washing solution of the storage tank by the automatic level adjustment mechanism, it is possible to immerse the contact position of the ejection surface and the washing member in the washing solution in a case of washing the ejection surface by the washing member. Therefore, it is possible to perform washing on the ejection surface in the washing solution, and it is possible to improve the washing efficiency. Also, in a case of wiping the ejection surface by the wiping member, if the solution level of the washing solution is positioned below the ejection surface, it is possible to surely wipe the ejection surface. Like these, by changing the position of the solution level of the washing solution of the storage tank by the automatic level adjustment mechanism, it is possible to more surely perform washing in a case of washing the ejection surface of the inkjet head using the washing member and the wiping member.

In the above-described head washing device, it is preferable that the wiping unit have a first drive mechanism for moving the wiping member between a first position where the contact portion is exposed from the washing solution of the storage tank and a second position where the contact portion is immersed in the washing solution of the storage tank.

The first drive mechanism moves the wiping member between the first position where the contact portion is exposed from the washing solution of the storage tank and the second position where the contact portion is immersed in the washing solution of the storage tank. Therefore, the contact portion of the wiping member can be immersed in the washing solution without controlling the solution level of the washing solution. Further, since the contact portion can be moved to the second position by the first drive mechanism, it is possible to suppress the contact portion from unexpectedly coming into contact with the ejection surface before it is washed by the washing member, thereby suppressing contaminations remaining on the contact portion from adhering to the ejection surface of the inkjet head.

In the above-described head washing device, it is preferable that the head washing device include a control unit for controlling the wiping unit such that the wiping unit wipes the ejection surface, after the washing member washes the ejection surface.

Since the washing solution and contaminations remaining on the ejection surface are wiped off by wiping the ejection surface by the wiping unit after the ejection surface is washed by the washing member, it is possible to make the ejection surface likely to dry while improving the washing efficiency of the ejection surface.

In the above-described head washing device, it is preferable that the washing unit include a second drive mechanism for rotating or vibrating the washing member.

The second drive mechanism rotates or vibrates the washing member. Therefore, the ejection surface of the inkjet head and the wiping member are more effectively washed. Further, since the washing member whose at least a portion has been immersed in the washing solution of the storage tank rotates or vibrates, contaminations having transferred from the ejection surface and the wiping member onto the washing member are mixed in the washing solution, whereby the washing member is washed.

In the above-described head washing device, it is preferable that the second drive mechanism be magnetically coupled with the washing member with a wall of the storage tank interposed therebetween, and rotate or vibrate the washing member.

The second drive mechanism is magnetically coupled with the washing member with the wall of the storage tank, and rotates or vibrates the washing member. Therefore, it is possible to rotate or vibrate the washing member without providing the second drive mechanism inside the storage tank or providing a member passing through the wall of the storage tank. Therefore, it is possible to downsize the storage tank, and the washing solution is suppressed from leaking from the storage tank.

An inkjet printer according to one embodiment of the present invention is characterized by including an inkjet head and the above-described head washing device.

In the above-described inkjet printer, it is preferable that the inkjet printer further include a supporting member configured to support the inkjet head and extend along a scan direction, and the inkjet head be movable along the supporting member, in a scan part for performing ink ejection and an extension part deviated from the scan part, and the head washing device wash the ejection surface of the inkjet head positioned in the extension part.

The head washing device washes the ejection surface of the inkjet head positioned in the extension part deviated from the scan part for performing ink ejection. Therefore, empty spaces of the inkjet printer can be effectively used, and the inkjet printer can be downsized.

Advantageous Effects of Invention

According to the present invention, it is possible to effectively wash the wiping member.

DESCRIPTION OF EMBODIMENTS

First Embodiment

Hereinafter, a first embodiment will be described with reference to FIG. 1 to FIG. 8. Also, with respect to each of some constituent elements according to embodiments and a description of the corresponding constituent element, a plurality of expressions will be used together. With respect to the corresponding constituent element and the description, it is not hindered to use other unused expressions. Also, with respect to each of constituent elements for which a plurality of expressions is not used and a description thereof, it is not hindered to use other expressions.

Figure 1:
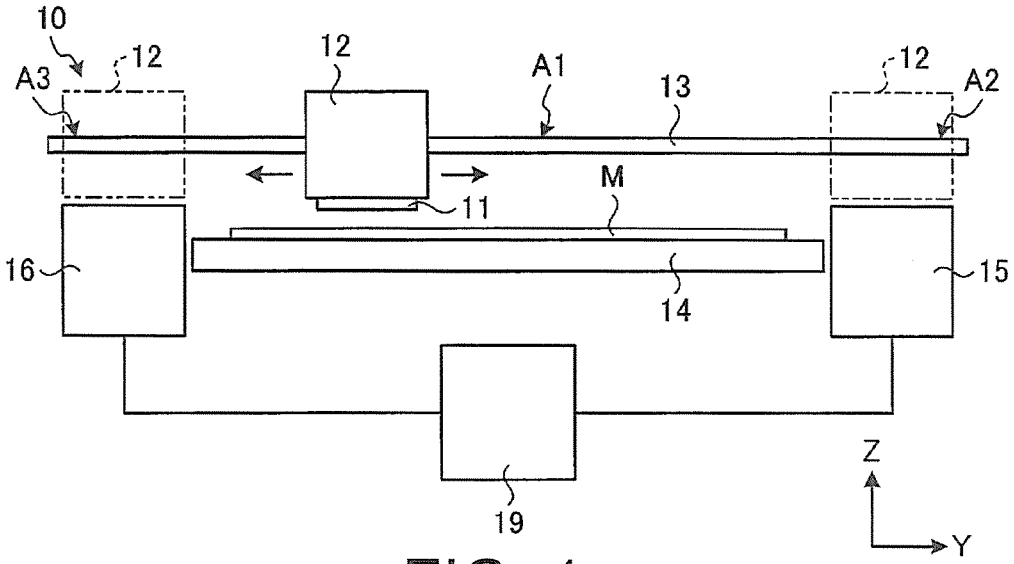
FIG. 1 is a view illustrating the configuration of an inkjet printer according to a first embodiment of the present invention.

FIG. 1 is a view illustrating the configuration of an inkjet printer 10 according to a first embodiment of the invention. As shown in FIG. 1, the inkjet printer 10 includes an inkjet head 11, a carriage 12, a bar 13, a table 14, a maintenance station 15, a washing station 16, and a controller 19. The bar 13 is an example of a supporting member. The washing station 16 is an example of a head washing device.

The inkjet head 11 has an ejection surface 26 having a plurality of nozzles, and the individual nozzles eject corresponding ink, respectively. For example, the inkjet printer 10 includes the inkjet head 11 having a plurality of nozzles corresponding to cyan (C), magenta (M), yellow (Y), black (K), white, and other colors, respectively. However, one or more inkjet heads 11 may be provided.

The carriage 12 holds the inkjet head 11. The bar 13 extends along a main scan direction, and moves in a sub scan direction by a drive mechanism using a motor or the like. On the bar 13, the carriage 12 is attached so as to be movable. In other words, the bar 13 supports the inkjet head 11 held by the carriage 12. The carriage 12 holding the inkjet head 11 moves along the bar 13 (along the main scan direction).

As shown in the drawings, in this specification, an X axis, a Y axis, and a Z axis are defined. The X axis, the Y axis, and the Z axis are perpendicular to one another. The X axis is parallel to the sub scan direction. The Y axis is parallel to the main scan direction. The Z axis is parallel to, for example, a vertical direction.

On the table 14, media M can be mounted. Media M is not limited to paper, and may be various materials such as plates, fabrics, and structures. The thickness of each medium M (the dimension in a direction parallel to the Z axis) depends on the corresponding medium M. Each medium M is positioned and fixed on the table 14, for example, by suction, pins, or the like. However, the present invention is not limited to the table 14, and each medium M may be supported on any other member such as a platen.

The bar 13 is disposed over the table 14 with a predetermined gap. Along the bar 13, the carriage 12 moves in a scan part (a scan path) A1 over a medium M mounted on the table 14, and two extension parts A2 and A3 (overrun sections) deviated from the scan part A1.

The inkjet head 11 ejects ink onto the medium M mounted on the table 14 when the carriage 12 is positioned in the scan part A1. The extension parts A2 and A3 are positioned at both end portions of the bar 13. In other words, between the two extension parts A2 and A3, the scan part A1 is positioned.

The maintenance station 15 moves in the sub scan direction together with the bar 13. The maintenance station 15 is disposed so as to face the inkjet head 11 of the carriage 12 positioned on one extension part A2.

The washing station 16 moves in the sub scan direction together with the bar 13. The washing station 16 is disposed so as to face the inkjet head 11 of the carriage 12 positioned on the other extension part A3.

Figure 2:
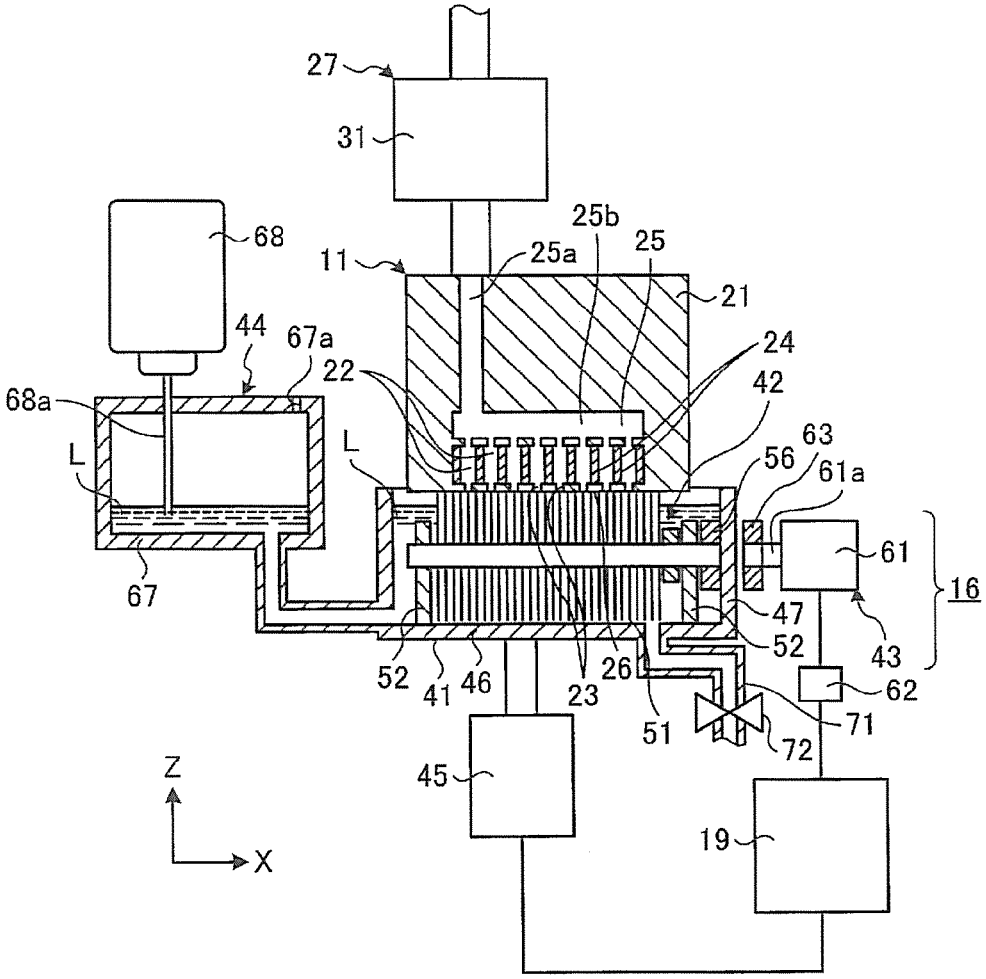
FIG. 2 is a cross-sectional view illustrating an inkjet head and a washing station.

FIG. 2 is a schematic diagram for explaining washing of the inkjet head 11, and is a cross-sectional view illustrating the inkjet head 11 and the washing station 16. As shown in FIG. 2, the inkjet head 11 includes a main body 21, a plurality of pressure chambers 22, a plurality of nozzles 23, a plurality of drive elements 24, and ink supply passages 25. Each of the ink supply passages 25 has a supply part 25*a* and a common part 25*b*, and is an example of a passage.

The main body 21 is formed substantially in a cuboid shape. However, the shape of the main body 21 is not limited thereto. The main body 21 has the ejection surface 26 substantially flat. The ejection surface 26 faces downward, and faces the table 14 and each medium M.

The plurality of pressure chambers 22 is provided inside the main body 21. The pressure chambers 22 are disposed side by side in a direction parallel to the X axis. The plurality of pressure chambers 22 connects the common parts 25*b* of the ink supply passages 25 and the plurality of nozzles 23.

The plurality of nozzles 23 is holes for ejecting the ink, and is formed in the ejection surface 26 of the main body 21. In other words, the ink is ejected from the ejection surface 26. The ink is an example of a first liquid. The nozzles 23 are connected to the common parts 25*b* of the ink supply passages 25 through corresponding pressure chambers 22. The nozzles 23 are disposed side by side in a direction parallel to the X axis.

The plurality of drive elements 24 is formed at parts of corresponding pressure chambers 22. The drive elements 24 are piezoelectric elements, and deform, thereby changing the internal ink pressures of the pressure chambers 22, if a voltage is applied. The drive elements 24 deform, thereby increasing or decreasing the internal ink pressures of the pressure chambers 22, thereby ejecting ink drops from the nozzles 23. Also, the drive elements 24 are not limited to those shown in FIG. 2, and can be applied to every drive method of the related art classifiable as a piezo manner. For example, the drive elements 24 may be elements laminated on diaphragm films constituting the pressure chambers 22. Also, the drive elements may be elements of a thermal type called thermal jet or bubble jet (registered as a trade mark).

The ink supply passages 25 are connected to the individual pressure chambers 22 by the common parts 25*b*, and are passages for supplying the ink from the supply parts 25*a* into the individual pressure chambers 22 through the common parts 25*b*. The ink supply passages 25 are connected to ink tanks corresponding to the nozzles 23 through an ink supply unit 27. The ink supply units 27 are examples of a liquid supply unit. The ink supply units 27 supply the ink of the ink tanks into the pressure chambers 22 and the nozzle 23 through the ink supply passages 25.

The ink supply units 27 have dampers 31. The dampers 31 are provided on passages provided between the ink tanks and the inkjet head 11. The dampers 31 mitigate change in ink pressure when the ink enters or exits from the inkjet head 11.

The maintenance station 15 shown in FIG. 1 regularly washes the inkjet head 11 at relatively short intervals, thereby maintaining the quality of printing using the inkjet head 11. In other words, the maintenance station 15 suppresses the ejection surface 26 from being contaminated, and keeps the viscosity of the ink of the nozzles 23 low, thereby stabilizing ink ejection of the inkjet head 11. The maintenance station 15 has a cap and wipers.

The cap of the maintenance station 15 covers the ejection surface 26 of the inkjet head 11 from below, thereby suppressing the ink of the nozzles 23 from drying. The inkjet head 11 performs flushing, that is, ejecting the ink into washing solution contained in the cap. The wipers wipe the ejection surface 26. However, in the present invention, the configuration of the maintenance station is not limited thereto as long as it has a maintenance function for the inkjet head 11.

The washing station 16 regularly washes the inkjet head 11 at relatively long intervals, such as once every day, or once every predetermined number of days, or once every week, thereby maintaining the quality of printing using the inkjet head 11. However, the washing station 16 may wash the inkjet head 11 only in a predetermined case, not regularly. The washing station 16 removes ink of a range from low viscosity to high viscosity from the ejection surface 26 and the nozzles 23, thereby returning the inkjet head 11 to its initial state.

As shown in FIG. 2, the washing station 16 includes a storage tank 41, a washing unit 42, a brush drive mechanism 43, an automatic level adjustment mechanism 44, and an actuator 45. The brush drive mechanism 43 is an example of a second drive mechanism.

The storage tank 41 is formed in a box shape with the upper end portion opened. However, the shape of the storage tank 41 is not limited thereto. In the storage tank 41, a washing solution L is stored. The washing solution L is an example of a second liquid, and is, for example, a solvent.

The storage tank 41 has a bottom wall 46 and a plurality of side walls 47. The plurality of side walls 47 stands up from the edges of the bottom wall 46, respectively. The bottom wall 46 and the side walls 47 are made of a non-magnetic material such as austenitic stainless steel (for example, SUS304) or a synthetic resin.

The washing unit 42 includes a brush 51 and two supporting walls 52. The brush 51 is an example of a washing member. The brush 51 is dipped in the washing solution L of the storage tank 41. The brush 51 has a rotary shaft 54, a plurality of hairs 55, and a first magnet 56.

If the inkjet head 11 reaches a washing position of the washing station 16, the actuator 45 moves the storage tank 41 toward the inkjet head 11, and holds the storage tank 41 at a position for a washing operation.

The rotary shaft 54 extends in a direction parallel to the X axis. The rotary shaft 54 is supported on the supporting walls 52 provided inside the storage tank 41, so as to be rotatable. The hairs 55 are disposed in the circumferential direction on the rotary shaft 54, and protrude in the radial direction from the rotary shaft 54. Therefore, the hairs 55 form a substantially cylindrical shape. The hairs 55 are made of a synthetic resin resistant to the solvent, such as polypropylene, nylon, and polycarbon. The first magnet 56 is attached to one end portion of the rotary shaft 54. The first magnet 56 faces a side wall 47 of the storage tank 41. The brush 51 is partially exposed from the washing solution L. However, the whole of the brush 51 may be immersed in the washing solution L.

The brush drive mechanism 43 includes a first motor 61, a driver circuit 62, and a second magnet 63. The first motor 61 is driven by the driver circuit 62. The second magnet 63 is attached to an output shaft 61*a* of the first motor 61. The second magnet 63 faces the first magnet 56 with the side wall 47 of the storage tank 41 interposed therebetween.

By the first magnet 56 and the second magnet 63, the brush drive mechanism 43 is magnetically coupled with the brush 51 with the side wall 47 of the storage tank 41 interposed therebetween. If the first motor 61 is driven, the second magnet 63 attached to the output shaft 61*a* rotates. As a result, the rotary shaft 54 having the first magnet 56 attached thereon also rotates. In other words, the brush drive mechanism 43 rotates the brush 51. By this method, it is possible to completely prevent leakage of the solution from the storage tank 41 along the rotary shaft. However, the rotary shaft 54 may pass through the side wall 47 of the storage tank 41 and be directly rotated by the first motor 61. In the case where the rotary shaft 54 is directly rotated by the first motor 61, the bottom wall 46 and the side walls 47 may not be made of a non-magnetic material, and may be made of, for example, a magnetic metal material.

The automatic level adjustment mechanism 44 includes an adjustment tank 67 and a supply tank 68. The adjustment tank 67 is connected to the storage tank 41 such that liquid can flow, and stores the washing solution L. The supply tank 68 is disposed above the adjustment tank 67, and stores the washing solution L.

In the adjustment tank 67, a connection hole 67*a* for connection with atmosphere is formed. From the bottom surface of the supply tank 68, a pipe 68*a* extends downward. The leading end of the pipe 68*a* is immersed under the solution level of the washing solution L stored in the adjustment tank 67.

The automatic level adjustment mechanism 44 can automatically supply the washing solution L into the storage tank 41, and keeps the solution level of the washing solution L of the storage tank 41 constant. The height of the solution level of the washing solution L in the adjustment tank 67 becomes equal to the height of the solution level of the washing solution L of the storage tank 41.

If the washing solution L is supplied into the storage tank 41, whereby the solution level of the washing solution L of the adjustment tank 67 lowers, the leading end of the pipe 68*a* of the supply tank 68 is exposed from the corresponding solution level. As a result, air enters the supply tank 68 from the leading end of the pipe 68*a*, whereby the pressure of the supply tank 68 rises, whereby the washing solution L of the supply tank 68 is supplied into the adjustment tank 67.

If the solution level of the washing solution L of the adjustment tank 67 rises, the leading end of the pipe 68*a* of the supply tank 68 soaks under the corresponding solution level. As a result, the inflow of air from the leading end of the pipe 68*a* is blocked, whereby the supply of the washing solution L from the supply tank 68 stops. Therefore, the solution level of the washing solution L of the adjustment tank 67 is kept in the vicinity of the leading end of the pipe 68*a*.

In the storage tank 41, an outlet 71 and a discharge valve 72 are provided. The outlet 71 is formed in the bottom wall 46 of the storage tank 41. The washing solution L stored in the storage tank 41 is discharged from the outlet 71. The discharge valve 72 is, for example, an electromagnetic valve. The discharge valve 72 blocks leakage of the washing solution L from the outlet 71.

The storage tank 41 can be moved along a direction parallel to the Z axis by the actuator 45. The actuator 45 moves the storage tank 41 in the direction of the Z axis, thereby preventing collision with the inkjet head 11 moving, and holds the position of the storage tank 41.

Figure 3:
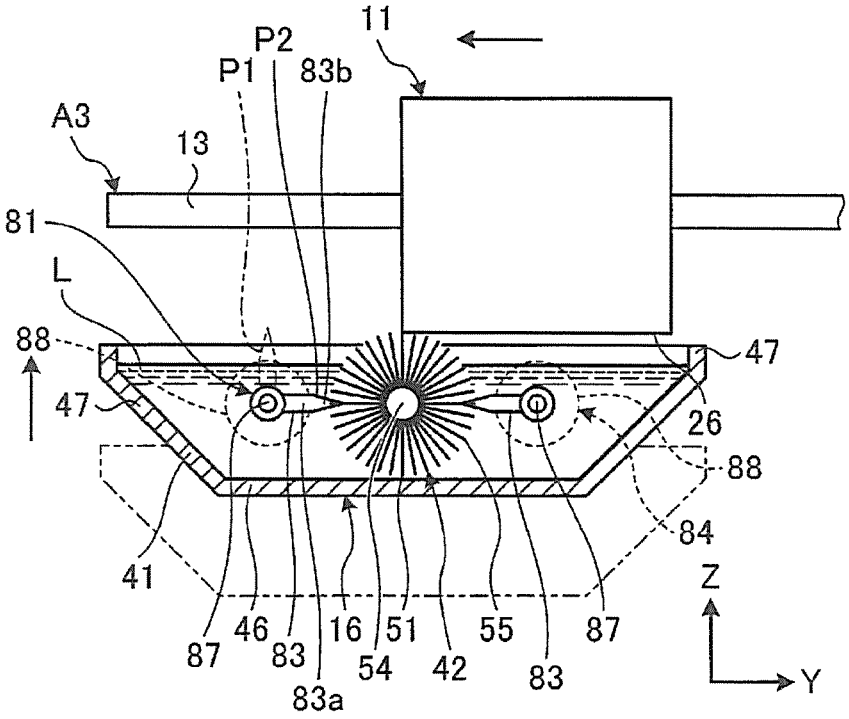
FIG. 3 is a cross-sectional view illustrating the inkjet head and the washing station as seen from a direction different from that of FIG. 2.

FIG. 3 is a cross-sectional view illustrating the inkjet head 11 and the washing station 16 as seen from a direction different from that of FIG. 2. As shown in FIG. 3, the washing station 16 further includes a wiping unit 81. The wiping unit 81 includes two wipers 83 and a wiper drive mechanism 84. The wipers 83 are examples of a wiping member. The wiper drive mechanism 84 is an example of a first drive mechanism.

The wipers 83 are made of an elastic material such as synthetic rubber. Each wiper 83 includes a base portion 83*a*, and a leading-end portion 83*b* thinner than the base portion 83*a*. The leading-end portion 83*b* is an example of a contact portion, and is more likely to bend than the base portion 83*a* is.

The wiper drive mechanism 84 includes two support shafts 87 and two second motors 88. The support shafts 87 are immersed in the washing solution L of the storage tank 41, and are supported so as to be rotatable. The second motors 88 are disposed outside the storage tank 41, and rotate the support shafts 87. The second motors 88 may be directly joined with the support shafts 87, or may be magnetically coupled with them.

The base portions 83*a* of the wipers 83 are attached to the support shafts 87. The wipers 83 may be attached to the support shafts 87 so as to be removable, and be exchangeable. The second motors 88 rotate the support shafts 87, whereby the wipers 83 are swung between exposure positions P1 and dip positions P2. The exposure positions P1 are examples of a first position. The dip positions P2 are examples of a second position. In FIG. 3, the wipers 83 which are at the exposure positions P1 are shown by alternate long and two short dashes lines.

At the exposure positions P1, the wipers 83 extend, for example, in a direction parallel to the Z axis. However, the wipers 83 which are at the exposure positions P1 are not limited thereto, and may be inclined with respect to the Z axis. The leading-end portions 83*b* of the wipers 83 can be protruded and exposed from the solution level of the washing solution L of the storage tank 41. The base portions 83*a* of the wipers 83 may be immersed in the washing solution L, or may be exposed from the washing solution L, for example, partially.

At the dip positions P2, the wipers 83 extend, for example, in a direction parallel to the Y axis. However, the wipers 83 which are at the dip positions P2 are not limited thereto. The base portions 83*a* and leading-end portions 83*b* of the wipers 83 can be immersed in the washing solution L of the storage tank 41.

At the dip positions P2, the leading-end portions 83*b* of the wipers 83 are in contact with the hairs 55 of the brush 51. Therefore, if the brush 51 is rotated by the brush drive mechanism 43, in the washing solution L, the hairs 55 of the brush 51 brush and wash the leading-end portions 83*b*.

Figure 4:
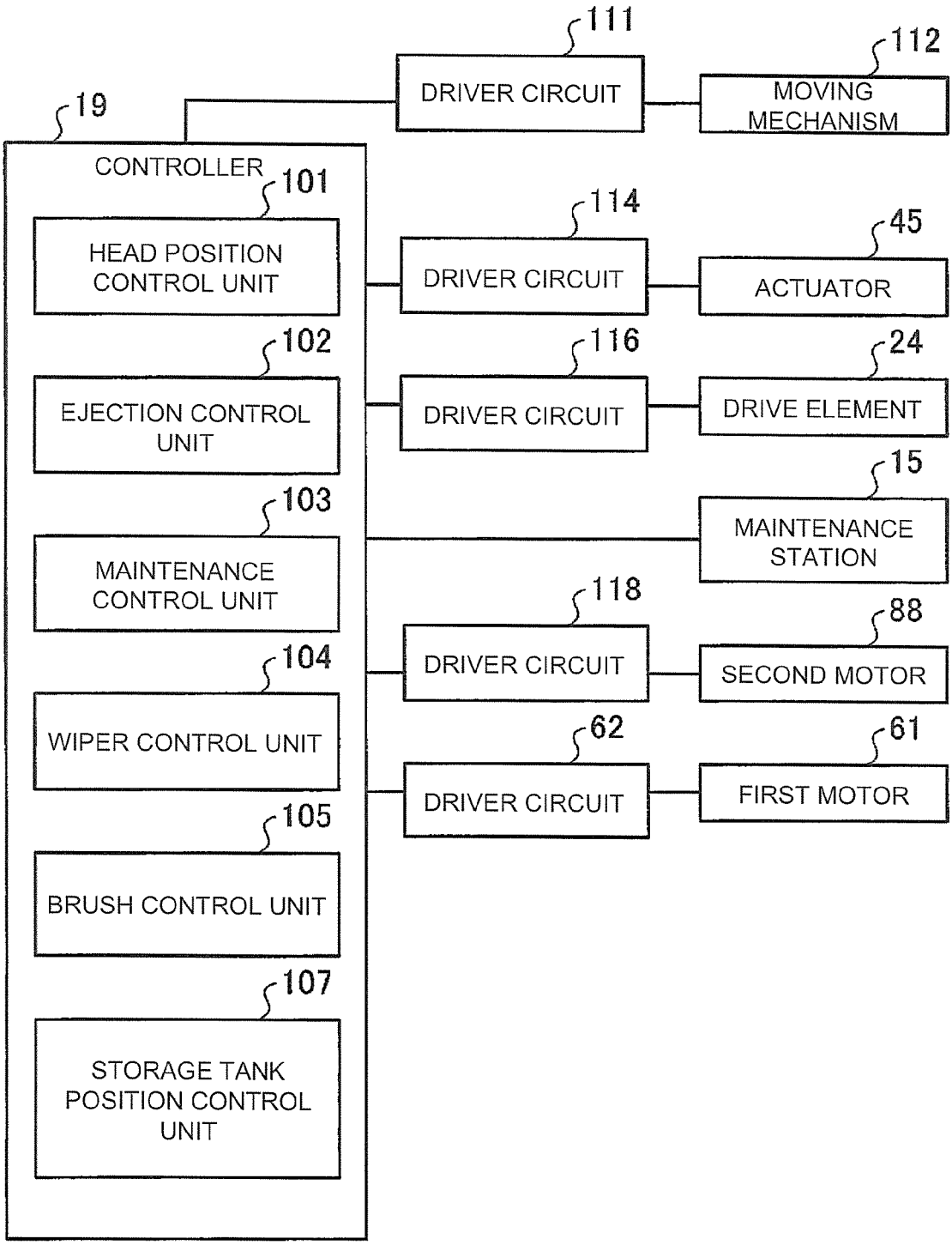
FIG. 4 is a block diagram illustrating an example of the configuration of a controller.

FIG. 4 is a block diagram illustrating an example of the configuration of the controller 19. The controller 19 controls operations of the inkjet printer 10. The controller 19 includes a head position control unit 101, an ejection control unit 102, a maintenance control unit 103, a wiper control unit 104, a brush control unit 105, and a storage tank position control unit 107.

The head position control unit 101 controls a moving mechanism 112 through a driver circuit 111. The moving mechanism 112 includes, for example, a motor, gears, and a belt, and moves the carriage 12 along the bar 13. In other words, the head position control unit 101 controls the positions of the inkjet head 11 and the carriage 12 in a Y direction.

The ejection control unit 102 controls the drive elements 24 of the inkjet head 11 through a driver circuit 116. In other words, the ejection control unit 102 controls the driver circuit 116, thereby supplying a drive voltage from the driver circuit 116 to the drive elements 24.

The ejection control unit 102 can selectively drive the plurality of drive elements 24. In other words, the ejection control unit 102 can drive at least one drive element 24, such that at least one nozzle 23 corresponding to the corresponding drive element 24 performs ejection of liquid such as ink. In other words, the ejection control unit 102, the driver circuit 116, and the drive elements 24 constitute an example of a first control mechanism.

The maintenance control unit 103 controls the maintenance station 15. The maintenance control unit 103 controls the motor and the electromagnetic valve included in the maintenance station 15, for example, through a driver circuit, thereby exchanging the washing solution stored in the cap, or wiping the ejection surface 26 of the inkjet head 11 with the wipers.

The wiper control unit 104 controls the second motors 88 of the wiping unit 81 through a driver circuit 118. In other words, the wiper control unit 104 makes the driver circuit 118 drive the second motors 88, such that the wipers 83 are swung between the exposure positions P1 and the dip positions P2.

The brush control unit 105 controls the first motor 61 through the driver circuit 62. The brush control unit 105 makes the driver circuit 62 drive the first motor 61, thereby rotating the brush 51 as described above.

The storage tank position control unit 107 controls the actuator 45 through a driver circuit 114. The actuator 45 moves the storage tank 41 in a direction parallel to the Z axis. In other words, the storage tank position control unit 107 controls the position of the storage tank 41 in a Z direction.

The controller 19, and the head position control unit 101, the ejection control unit 102, the maintenance control unit 103, the wiper control unit 104, the brush control unit 105, and the storage tank position control unit 107 included in the controller, and the like are composed of hardware such as an arithmetic device and a memory, and programs for implementing predetermined functions of them.

Figure 5:
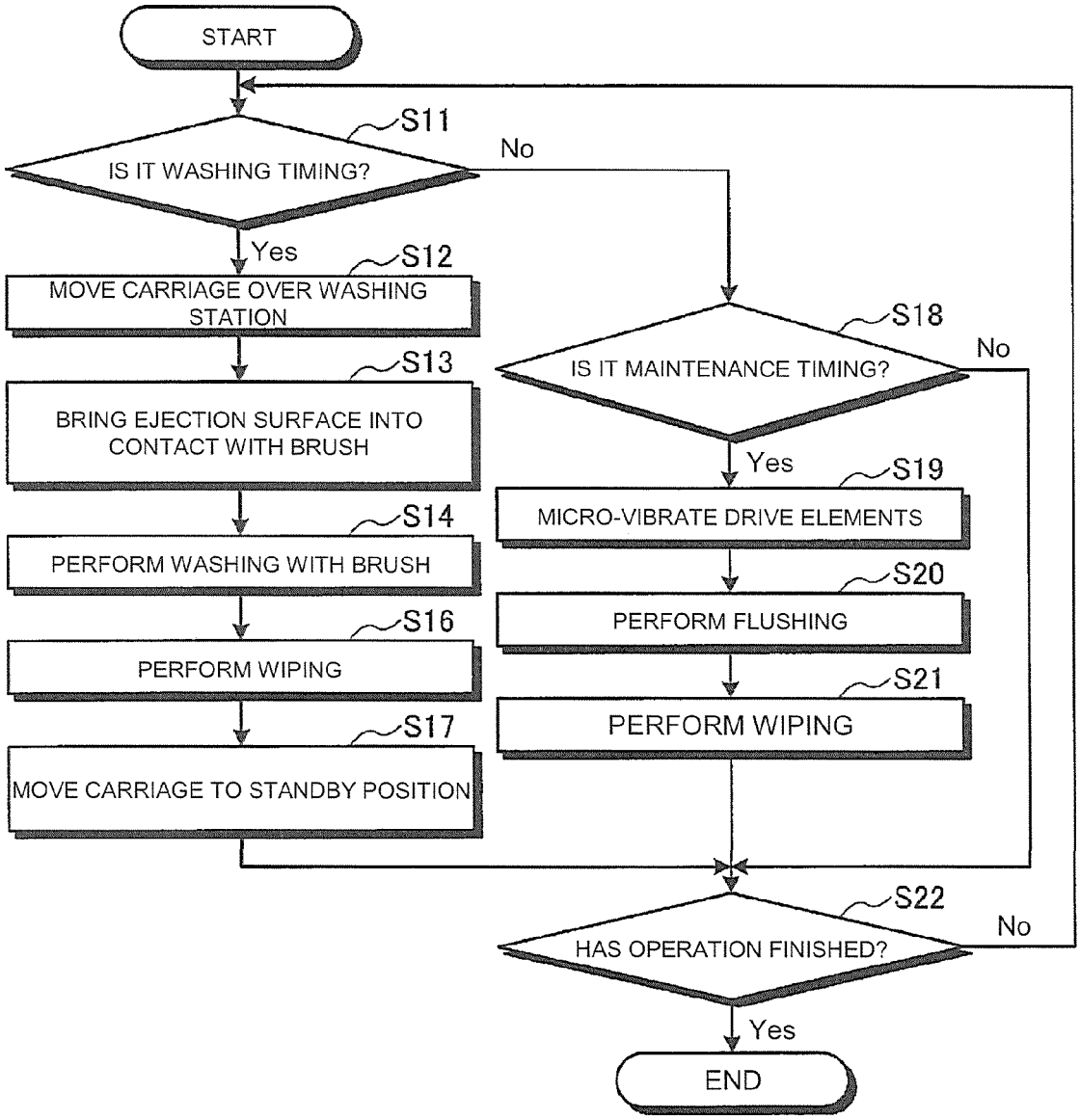
FIG. 5 is a flow chart illustrating an example of an operation of the inkjet printer.

Now, an operation of the inkjet printer 10 described above will be described. FIG. 5 is a flow chart illustrating an example of the operation of the inkjet printer 10. The operation of the inkjet printer 10 to be described below is performed, for example, by a predetermined program.

The inkjet printer 10 performs printing on a medium M, for example, in response to a print command from an external personal computer or an operation unit provided on the inkjet printer 10. In other words, on the basis of the corresponding print command, the inkjet printer 10 moves the carriage 12 and the bar 13 in the sub scan direction and the main scan direction. The inkjet head 11 ejects the ink from the nozzles 23 onto the medium M, whereby an image is forming on the medium M.

During the printing, the carriage 12 moves in the scan part A1 and the extension parts A2 and A3 along the bar 13. The carriage 12 moves from one extension part A2 to the other extension part A3 through the scan part A1. The carriage 12 having reached the other extension part A3 returns to the initial extension part A2 (a standby position). In other words, the carriage 12 performs movement direction reversal in the extension parts A2 and A3.

Each of the maintenance station 15 and the washing station 16 faces the inkjet head 11 positioned in an empty space (the extension part A2 or A3) necessary for reversal of the carriage 12. Therefore, downsizing of the inkjet printer 10 is possible.

While the inkjet printer 10 is operating like during the printing described above, the controller 19 determines whether it is a timing to perform washing on the inkjet head 11 (STEP S11). For example, in a case where time is counted by a timer, and the counted time reaches a predetermined period, the controller 19 determines that it is a timing to perform washing on the inkjet head 11 ("Yes" in STEP S11). The corresponding period is, for example, half a day or a time required for deposition or condensation of the ink to occur. In a case where it is determined that it is a timing to perform washing on the inkjet head 11, the time count of the timer is reset.

For example, when the operation of the inkjet printer 10 finishes (during a long idle period), or when it is estimated that the viscosity of the ink contained in the inkjet head 11 is about 20 millipascals or higher, the controller 19 may determine that it is a timing to perform washing on the inkjet head 11. However, a criterion for determining that it is a timing to perform washing on the inkjet head 11 is not limited thereto.

If it is determined that it is a timing to perform washing on the inkjet head 11, the head position control unit 101 of the controller 19 controls the moving mechanism 112, thereby moving the carriage 12 to the extension part A3. In other words, the carriage 12 is moved over the washing station 16 (STEP S12).

Subsequently, the storage tank position control unit 107 controls the actuator 45, thereby raising the storage tank 41.

As a result, as shown in FIG. 3, the ejection surface 26 of the inkjet head 11 comes into contact with the hairs 55 of the brush 51 (STEP S13).

Figure 6:
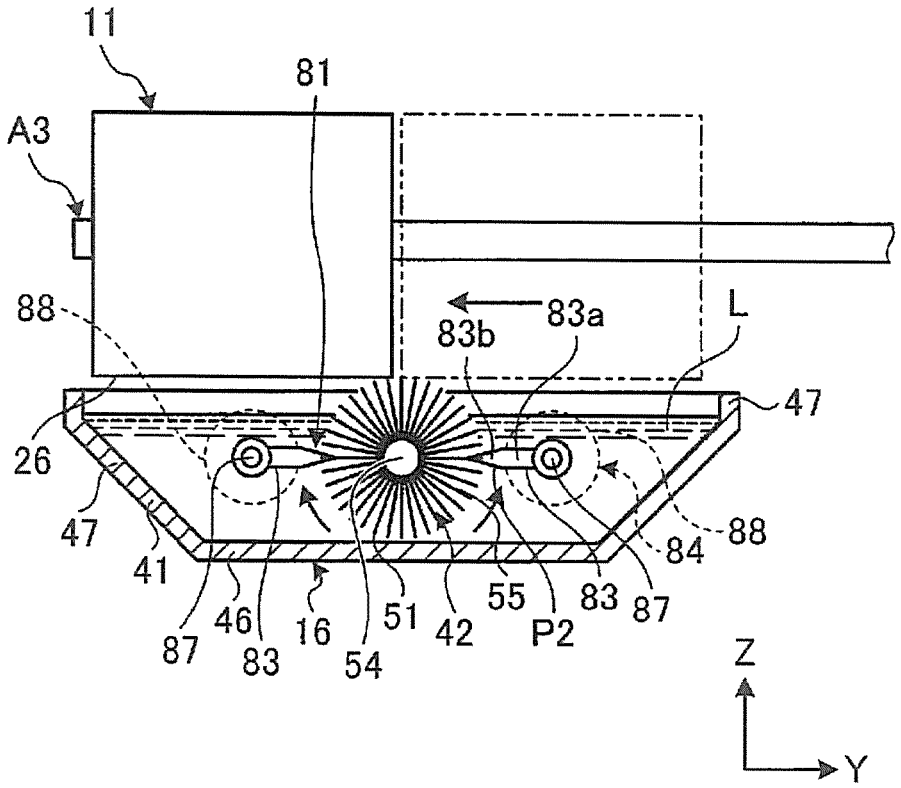
FIG. 6 is a cross-sectional view illustrating the inkjet head and the washing station in a brush washing process.

Subsequently, the head position control unit 101 controls the moving mechanism 112, thereby moving the inkjet head 11 in a direction parallel to the Y axis. FIG. 6 is a cross-sectional view illustrating the inkjet head 11 and the washing station 16 in a brush washing process. As shown in FIG. 6, the hairs 55 of the brush 51 come into contact with the ejection surface 26 of the inkjet head 11 moving.

While the inkjet head 11 is moved, the brush control unit 105 controls the brush drive mechanism 43 such that the brush 51 is rotated. The brush 51 may be rotated only in a normal rotation direction, or may be rotated in the normal and reverse rotation directions by reversing the rotation direction at predetermined intervals.

The hairs 55 of the rotating brush 51 remove contaminations attached to the ejection surface 26 of the inkjet head 11 (STEP S14). A portion of the brush 51 exposed from the washing solution L brushes and washes the ejection surface 26 of the inkjet head 11. The brush 51 draws up the washing solution L by rotating. As a result, the washing solution L is dashed on the ejection surface 26, whereby the ejection surface 26 is washed. Further, since a portion of the brush 51 is dipped in the washing solution L, a number of hairs 55 of the brush 51 get wet with the washing solution L. The hairs 55 of the brush 51 wet with the washing solution L brush the ejection surface 26 of the inkjet head 11, whereby the ejection surface 26 is effectively washed.

However, prior to STEP S14, the ejection surface 26 may be immersed in the washing solution L, and if the ejection surface 26 is immersed in the washing solution L, the concentration of the ink attached to the ejection surface 26 decreases. Further, if the brush 51 brushes the ejection surface 26 in the state where the ejection surface is under the washing solution L, contaminations of the ejection surface 26 are effectively removed.

Meanwhile, the wipers 83 are disposed basically at the dip positions P2. Therefore, the hairs 55 of the brush 51 rotating brush the leading-end portions 83*b* of the wipers 83 under the washing solution L, thereby removing contaminations attached to the leading-end portions 83*b*. Contaminations of the other portions of the wipers 83 can also be removed by the washing solution L. Also, the wipers 83 do not come into contact with the inkjet head 11 moving. As described above, when the brush 51 washes the wipers 83, the wipers 83 are immersed in the washing solution L of the storage tank 41.

The contaminations of the ejection surface 26 of the inkjet head 11 and the contaminations of the leading-end portions 83*b* of the wipers 83 removed by the brush 51 are mixed in the washing solution L. In other words, even if the contaminations adhere to the hairs 55 of the brush 51, since the brush 51 rotates in the washing solution L, the contaminations of the hairs 55 are removed by the washing solution L.

Figure 7:
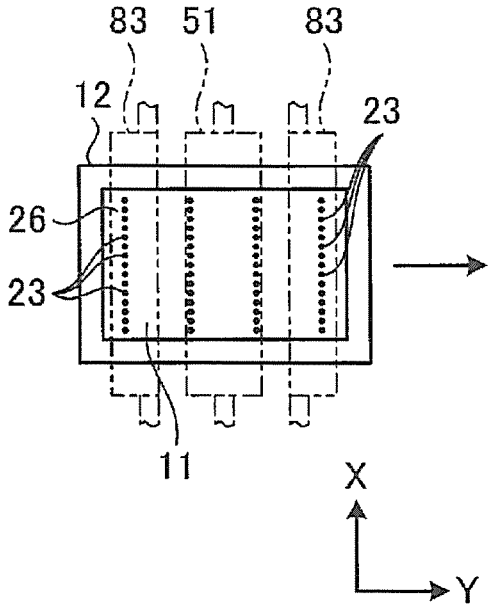
FIG. 7 is a bottom view illustrating a carriage and a brush.

FIG. 7 is a bottom view illustrating the carriage 12 and the brush 51. If the length of the brush 51 (the dimension along the X axis) is set to be longer than the length of the inkjet head 11 as shown in FIG. 7, it is possible to wash the whole of the ejection surface 26. Meanwhile, the width of the brush 51 (the diameter, that is, the dimension along the Y axis) may be narrower than the width of the inkjet head 11, and thus downsizing is possible. Also, if the lengths of the wipers 83 (the dimension along the X axis) are set to be longer than the length of the inkjet head 11, it is possible to wipe the whole of the ejection surface 26. The widths of the wipers 83 (the dimensions along the Y axis) may be set to be narrower than the width of the inkjet head 11, and thus downsizing is possible.

Figure 8:
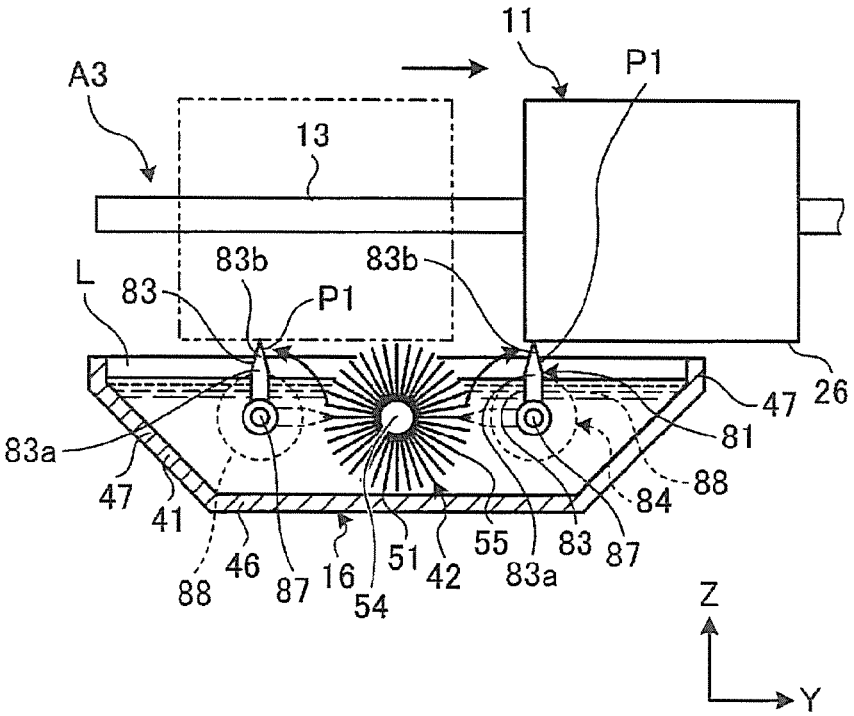
FIG. 8 is a cross-sectional view illustrating the inkjet head and the washing station in a wiping process.

FIG. 8 is a cross-sectional view illustrating the inkjet head 11 and the washing station 16 in a wiping process. After the washing of the inkjet head 11, as shown in FIG. 8, the wiper control unit 104 controls the second motors 88, thereby moving the wipers 83 to the exposure positions P1. As a result, the leading-end portions 83*b* of the wipers 83 are exposed from the solution level of the washing solution L.

If the washing on the ejection surface 26 by the brush 51 (STEP S14) finishes, the head position control unit 101 controls the moving mechanism 112, thereby moving the inkjet head 11 in a direction parallel to the Y axis. The leading-end portions 83*b* of the wipers 83 come into contact with the ejection surface 26 of the moving inkjet head 11.

The leading-end portions 83*b* of the wipers 83 wipe the ejection surface 26 of the moving inkjet head 11, whereby the washing solution L and contaminations remaining on the ejection surface 26 are removed (STEP S16). In this way, the ejection surface 26 becomes likely to dry while being washed.

As described above, if the washing on the ejection surface 26 by the brush control unit 105 (STEP S14) finishes, the controller 19 controls the head position control unit 101 and the wiper control unit 104, thereby performing control to perform wiping on the ejection surface 26 by the wipers 83 (STEP S16). The controller 19 is an example of a control unit.

Subsequently, the head position control unit 101 controls the moving mechanism 112, thereby moving the carriage 12 to the extension part A2 (the standby position) (STEP S17). By the above-described operation, the washing on the inkjet head 11 by the washing station 16 is completed.

Also, in a case where it is determined that it is not a timing to perform washing on the inkjet head 11 ("No" in STEP S11), the controller 19 determines whether t is a timing to perform maintenance of the inkjet head 11 (STEP S18). For example, in a case where time is counted by another timer, and the counted time reaches a predetermined period, the controller 19 determines that it is a timing to perform maintenance of the inkjet head 11 ("Yes" in STEP S18). The corresponding period is shorter than a period for determining a timing to perform washing on the inkjet head 11. In a case where it is determined that it is a timing to perform maintenance on the inkjet head 11, the time count of the corresponding timer is reset.

For example, when it is determined that the viscosity of the ink contained in the inkjet head 11 is predetermined viscosity of about 20 millipascal-second (mPa·s) or lower, the controller 19 may determine that it is a timing to perform maintenance on the inkjet head 11. However, a criterion for determining that it is a timing to perform maintenance of the inkjet head 11 is not limited thereto.

If it is determined that it is a timing to perform maintenance on the inkjet head 11, in a state where the carriage 12 is in the extension part A2 (the standby position), the ejection control unit 102 of the controller 19 controls the drive elements 24, thereby micro-vibrating the drive elements 24 (STEP S19). Although the drive elements 24 increase or decrease the ink pressures of the pressure chambers 22, the corresponding ink is not ejected from the nozzles 23. By the corresponding micro-vibration, the ink meniscuses of the nozzles 23 vibrate, whereby drying and viscosity increasing of the ink in the vicinities of the nozzles 23 are suppressed. However, micro-vibration of the drive elements 24 is not limited to a maintenance period, and may be always performed during the operation of the inkjet printer 10.

Subsequently, the ejection control unit 102 controls the drive elements 24, thereby performing flushing, that is, ejecting the ink from the nozzles 23 (STEP S20). The ink is ejected from the nozzles 23 into the washing solution of the cap of the maintenance station 15. In this way, for example, the ink having higher viscosity due to drying in the vicinities of the nozzles 23 is discharged, whereby clogging of the nozzles 23 and flight curves of ink drops are suppressed.

Subsequently, the maintenance control unit 103 wipes the ejection surface 26 of the inkjet head 11 by the wipers of the maintenance station 15 (STEP S21). As a result, contaminations such as the ink and dust attached to the ejection surface 26 are removed.

By the above-described operation, maintenance on the inkjet head 11 by the maintenance station 15 is completed. However, the maintenance station 15 may select and perform at least one of micro-vibrating (STEP S19), flushing (STEP S20), and wiping (STEP S21).

Further, the maintenance station 15 may suck the washing solution of the cap from the nozzles 23 of the ejection surface 26 of the inkjet head 11 covered by the cap. In this way, the ink and contaminations with higher viscosity contained in the inkjet head 11 can be removed.

The controller 19 repeats washing (STEPS S11 to S17) and maintenance (STEPS S18 to S21) of the inkjet head 11 described above, until the operation of the inkjet printer 10 finishes (STEP S22). In this way, the inkjet head 11 is kept clean, and the quality of printing is maintained.

In the inkjet printer 10, precipitation of pigments of the ink in ink tubes (ink passages between the ink tanks and the inkjet head 11) can be suppressed by providing annular passages between the dampers 31 and the ink tanks and performing ink circulation. Generation of contaminations on the dampers 31 is suppressed by flushing (STEP S20) of the maintenance station 15.

Generation of contaminations on the ejection surface 26 of the inkjet head 11 is suppressed by brush washing (STEP S14) of the washing station 16. Thickening of the ink meniscuses of the nozzles 23 is suppressed by flushing (STEP S20) of the maintenance station 15.

As described above, generation of contaminations and the like which can cause a failure of printing of the inkjet head 11 is suppressed by the maintenance station 15 and the washing station 16. In other words, by combining the maintenance station 15 and the washing station 16, the inkjet head 11 is effectively maintained.

According to the inkjet printer 10 related to the first embodiment, the washing unit 42 washes the wipers 83 for wiping the ejection surface 26 of the inkjet head 11, using the washing solution L of the storage tank 41. Contaminations attached to the wipers 83 are mixed in the large amount of washing solution L of the storage tank 41. In this way, the wipers 83 are effectively washed, and contaminations remaining on the wipers 83 are suppressed from adhering to the ejection surface 26 of the inkjet head 11.

In the above-described first embodiment, the brush 51 may be vibrated by the brush drive mechanism 43. The brush 51 brushes and washes the ejection surface 26 of the inkjet head 11 by vibrating.

The method of performing washing by bringing the brush 51 into contact with the ejection surface 26 like in the first embodiment described above is efficient particularly in a case of ejecting any one of emulsion ink and ultraviolet curing type ink as ink from the ejection surface 26. If emulsion ink and ultraviolet curing type ink harden once, since weatherability is high, it is difficult for them to be removed by subsequent washing. In other words, in a case where washing of the ejection surface of the inkjet head is insufficient, if such ink hardens on the ejection surface, it is difficult to remove it from the ejection surface by subsequent washing. Therefore, washing of the ejection surface of the inkjet head needs to be properly performed at appropriate timings. Also, the type of the solvent of the washing solution L may be appropriately selected according to the type of ink.

Second Embodiment

Hereinafter, a second embodiment will be described with reference to FIG. 9. Also, in the following embodiment description, constituent elements having the same functions as those of constituent elements having been already described are denoted by the same reference symbols, and may not be described. Also, a plurality of constituent elements denoted by the same reference symbol is not limited to a case where every function and every property are common, and may have different functions and different properties according to individual embodiments.

Figure 9:
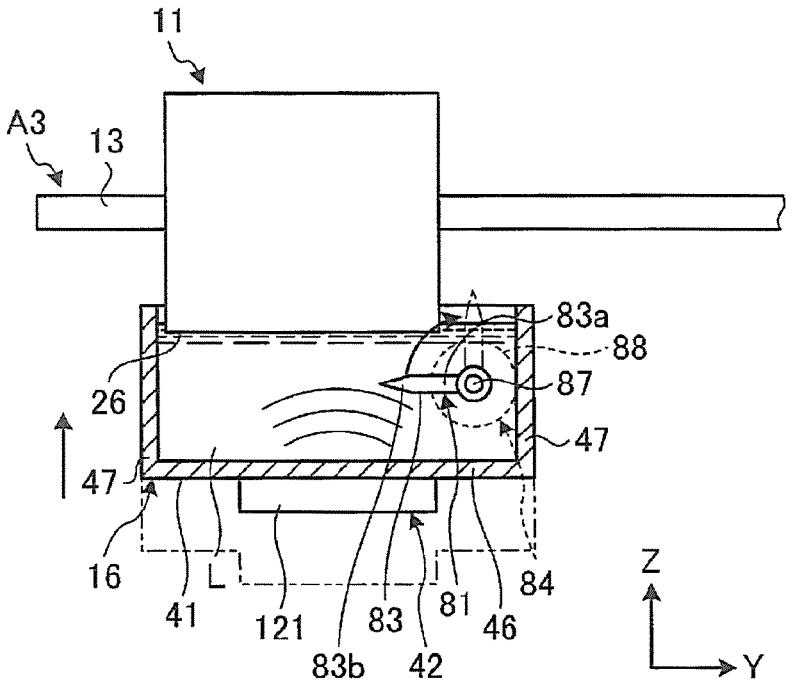
FIG. 9 is a cross-sectional view illustrating an inkjet head and a washing station according to a second embodiment of the present invention.

FIG. 9 is a cross-sectional view illustrating an inkjet head 11 and a washing station 16 according to the second embodiment. As shown in FIG. 9, the washing unit 42 of the second embodiment includes an ultrasonic washing device 121, in place of the brush 51.

The ultrasonic washing device 121 is attached to the storage tank 41, and makes ultrasonic waves propagate in the washing solution L stored in the storage tank 41. The corresponding ultrasonic waves wash the ejection surface 26 of the inkjet head 11 immersed in the washing solution L, and the wipers 83.

Like the ultrasonic washing device 121 of the second embodiment, the washing unit 42 may wash the ejection surface 26 of the inkjet head 11 and the wipers 83, without contacts. Also, the washing unit 42 may include both of the brush 51 of the first embodiment and the ultrasonic washing device 121 of the second embodiment.

The wiping unit 81 of the second embodiment includes one wiper 83. The number of wipers 83 may be two like in the first embodiment, or may be one like in the second embodiment, or may be any other number.

Also, the automatic level adjustment mechanism 44 may change the position of the solution level of the washing solution L of the storage tank 41, if necessary. In other words, since the height of the solution level of the washing solution L of the storage tank 41 becomes equal to the height of the solution level of the washing solution L of the adjustment tank 67 of the automatic level adjustment mechanism 44, the height of the solution level of the washing solution L of the storage tank 41 may be adjusted by adjusting the height of the solution level of the washing solution L of the adjustment tank 67. In order to implement this, for example, the automatic level adjustment mechanism 44 may be configured such that the supply tank 68 is movable in a vertical direction.

In a case where the supply tank 68 of the automatic level adjustment mechanism 44 is configured so as to be movable in a vertical direction, if the height of the solution level of the washing solution L of the storage tank 41 is raised, the supply tank 68 is raised, whereby the leading end of the pipe 68*a* is exposed from the solution level of the washing solution L, whereby air enters the supply tank 68 from the leading end of the pipe 68*a*. In the case where air enters the supply tank 68, since the internal pressure of the supply tank 68 increases, due to this pressure change, it is possible to supply the washing solution L of the supply tank 68 into the adjustment tank 67, and it is possible to raise the solution level of the washing solution L of the adjustment tank 67. As a result, it is possible to raise the solution level of the washing solution L of the storage tank 41.

Also, in a case of lowering the height of the washing solution L of the storage tank 41, the height of the leading end of the pipe 68*a* is lowered by lowering the supply tank 68, and the discharge valve 72 of the storage tank 41 is opened, whereby a portion of the washing solution L stored in the storage tank 41 is discharged from the outlet 71. In this way, it is possible to lower the solution level of the washing solution L of the storage tank 41 together with the solution level of the washing solution L of the adjustment tank 67.

Like these, in a case where the automatic level adjustment mechanism 44 is configured so as to be able to change the height of the solution level of the washing solution L of the storage tank 41, the height of the solution level may be changed according to steps during washing of the inkjet head 11. Specifically, in a case where washing of the inkjet head 11 is performed by the washing station 16, between during brush washing using the brush 51 and during wiping using the wipers 83, the height of the solution level of the washing solution L may be changed by the automatic level adjustment mechanism 44.

Figure 10:
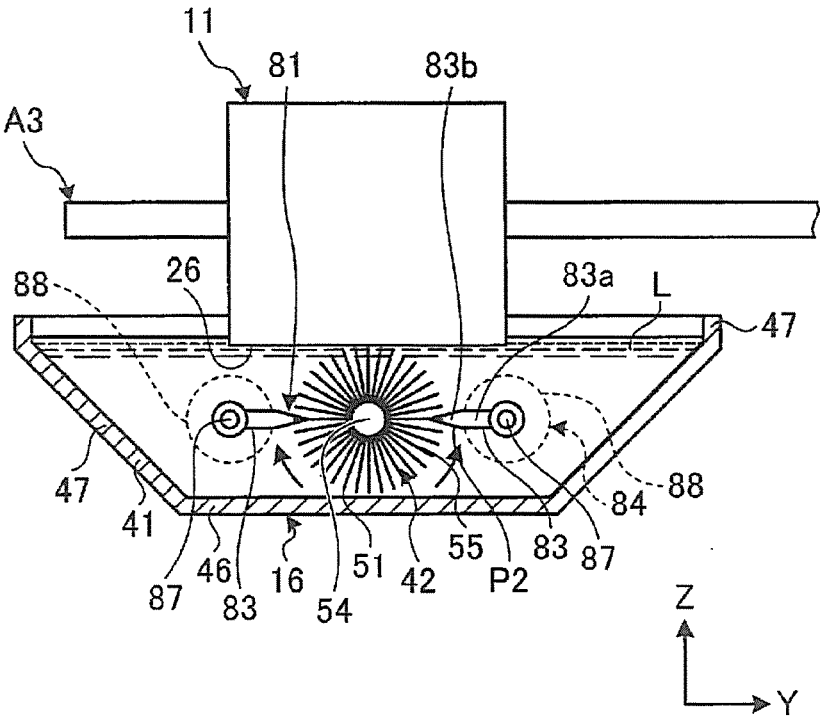
FIG. 10 is an explanatory view of an operation of a modification of the first embodiment when an ejection surface is washed by a brush.

FIG. 10 is an explanatory view of an operation of a modification of the first embodiment during washing of the ejection surface 26 by the brush 51. For example, in a case of washing the ejection surface 26 of the inkjet head 11 by the brush 51, the solution level of the washing solution L of the storage tank 41 may be adjusted by the automatic level adjustment mechanism 44 such that the height of the solution level of the washing solution L becomes a height equal to or higher than a contact position of the ejection surface 26 and the brush 51. In the case of performing washing of the ejection surface 26 by the brush 51, it is possible to perform washing on the ejection surface 26 by the brush 51 in the washing solution L by making the height of the solution level of the washing solution L of the storage tank 41 such a height that the contact position of the ejection surface 26 and the brush 51 is immersed. In this case, it is possible to improve the washing efficiency.

Figure 11:
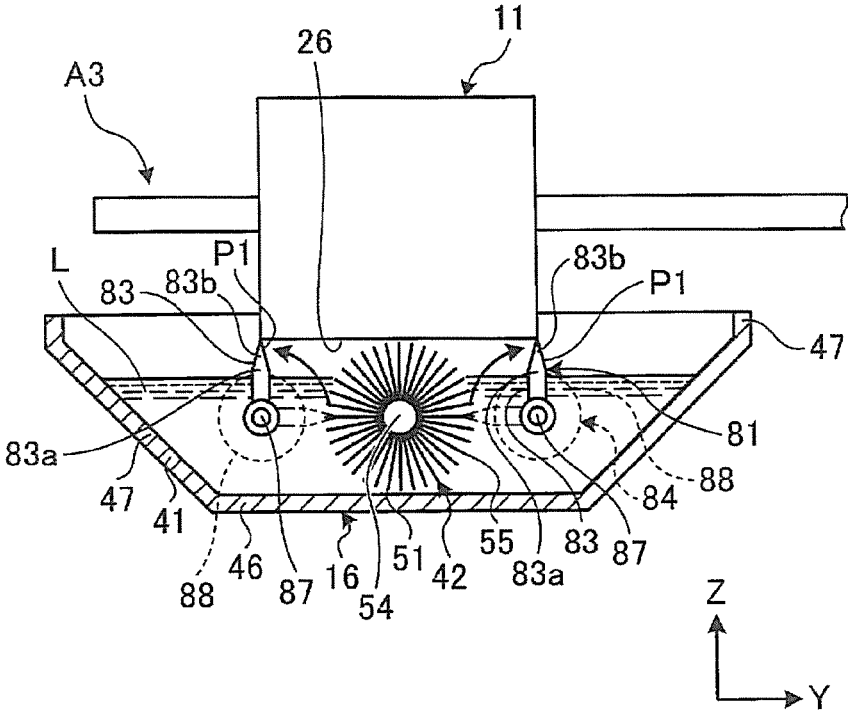
FIG. 11 is an explanatory view of an operation of a modification of the first embodiment when an ejection surface is wiped by wipers.

FIG. 11 is an explanatory view of an operation of a modification of the first embodiment during wiping on the ejection surface 26 by the wipers 83. Also, in a case of wiping the ejection surface 26 of the inkjet head 11 by the wipers 83, the solution level of the washing solution L of the storage tank 41 may be lowered such that the height of the solution level is positioned below the leading-end portions 83*b* of the wipers 83. In other words, the height of the solution level of the washing solution L of the storage tank 41 may be adjusted by the automatic level adjustment mechanism 44 such that the position of the solution level of the washing solution L is set below the ejection surface 26. Since wiping on the ejection surface 26 by the wipers 83 is performed by wiping off the washing solution L attached to the ejection surface 26 of the inkjet head 11, if the solution level of the washing solution L is positioned below the ejection surface 26, it is possible to surely wipe the ejection surface 26. Like these, if the position of the solution level of the washing solution L of the storage tank 41 is changed by the automatic level adjustment mechanism 44, it is possible to more surely perform washing in a case of washing the ejection surface 26 of the inkjet head 11 using the brush 51 and the wipers 83.

However, the height of the solution level of the washing solution L by the automatic level adjustment mechanism 44 may be adjusted by a method other than the method of moving the supply tank 68 in the vertical direction. For example, a means for supplying the washing solution L, such as a pump, may be provided in the automatic level adjustment mechanism 44 such that the washing solution L is supplied from the supply means into the adjustment tank 67 directly or through the supply tank 68. Like this, by providing a means for supplying the washing solution L so as to supply the washing solution L into the adjustment tank 67, it is possible to adjust the height of the solution level of the washing solution L of the adjustment tank 67, and it is possible to adjust the height of the solution level of the washing solution L of the storage tank 41.

The embodiments of the present invention described above are not intended to restrict the scope of the invention, and are just examples included in the scope of the invention. Also, the schematic diagrams do not show the structure of an actual inkjet head, and the ink passages, the ink drive elements, and the like are different from their actual shapes. Some embodiments of the present invention may be obtained by making changes, omissions, and additions on the above-described embodiments, for example, with respect to at least some of specific uses, structures, shapes, functions, and effects, without departing from the gist of the invention.

For example, a portion of the brush 51 of the washing unit 42 may be protruded from a side wall 47 of the storage tank 41. If a portion of the brush 51 is provided so as to protrude from the storage tank 41 and be in contact with the ejection surface 26 of the inkjet head 11, position control on the storage tank 41 by the actuator 45 may not be performed.

The invention claimed is:

1. A head washing device, comprising:

a wiping unit including a wiping member for wiping an ejection surface of an inkjet head for ejecting ink;

a storage tank for storing a washing solution for washing the wiping unit; and a washing unit for washing the wiping member in the washing solution of the storage tank, wherein the washing unit includes a washing member whose at least a portion is immersed in the washing solution of the storage tank and which comes into contact with the ejection surface of the inkjet head and the wiping member and washes the ejection surface and the wiping member.

2. The head washing device according to claim 1, further comprising:

a controller for controlling the wiping unit such that the wiping unit wipes the ejection surface, after the washing member washes the ejection surface.

3. The head washing device according to claim 1, wherein the wiping member has a contact portion which is in contact with the ejection surface of the inkjet head, and the contact portion is exposed from the washing solution of the storage tank when the wiping member wipes the ejection surface, and is immersed in the washing solution of the storage tank when the washing unit washes the wiping member.

4. The head washing device according to claim 3, further comprising:

an automatic level adjustment mechanism capable of changing a position of a solution level of the washing solution of the storage tank.

5. The head washing device according to claim 3, wherein the wiping unit has a first drive mechanism for moving the wiping member between a first position where the contact portion is exposed from the washing solution of the storage tank and a second position where the contact portion is immersed in the washing solution of the storage tank.

6. The head washing device according to claim 1, wherein the washing unit includes a second drive mechanism for rotating or vibrating the washing member.

7. The head washing device according to claim 6, wherein the second drive mechanism is magnetically coupled with the washing member with a wall of the storage tank interposed therebetween, and rotates or vibrates the washing member.

8. An inkjet printer, comprising:

the inkjet head; and the head washing device according to claim 1.

9. The inkjet printer according to claim 8, further comprising:

a supporting member configured to support the inkjet head and extend along a scan direction, wherein the inkjet head is movable along the supporting member, in a scan part for performing ink ejection and an extension part deviated from the scan part, and the head washing device washes the ejection surface of the inkjet head positioned in the extension part.

10. The inkjet printer according to claim 8, further comprising:

a supporting member configured to support the inkjet head and extend along a scan direction, wherein the inkjet head is movable along the supporting member, in a scan part for performing ink ejection and an extension part deviated from the scan part, and the head washing device washes the ejection surface of the inkjet head positioned in the extension part.

* * * * *